US006715570B1

(12) United States Patent
Downton et al.

(10) Patent No.: US 6,715,570 B1
(45) Date of Patent: Apr. 6, 2004

(54) TWO STAGE DOWNHOLE DRILLING FLUID FILTER

(75) Inventors: Geoff Downton, Minchinhampton (GB); Christian Menger, Bristol (GB); Henry Phan, Richmond, TX (US)

(73) Assignee: Schumberger Technology Corporation, Sugarland, TX (US)

( * ) Notice: Subject to any disclaimer, the term of this patent is extended or adjusted under 35 U.S.C. 154(b) by 0 days.

(21) Appl. No.: 10/065,100

(22) Filed: Sep. 17, 2002

(51) Int. Cl.[7] ..... E21B 43/08; E21B 7/04

(52) U.S. Cl. ..... 175/314; 175/312; 175/61

(58) Field of Search ..... 175/314, 312, 175/324, 226, 61

(56) References Cited

U.S. PATENT DOCUMENTS

| | | | | | |
|---|---|---|---|---|---|
| 90,787 | A | | 6/1869 | Rumsey et al. | |
| 673,398 | A | * | 5/1901 | Keller et al. | 175/19 |
| 679,131 | A | | 7/1901 | Thompson | |
| 713,544 | A | | 11/1902 | Ware | |
| 1,342,986 | A | | 6/1920 | Cater | |
| 1,520,376 | A | | 12/1924 | Verneuil | |
| 1,547,240 | A | * | 7/1925 | Steele | 166/264 |
| 1,816,767 | A | * | 7/1931 | Dobrinski | 175/235 |
| 2,530,223 | A | | 11/1950 | Breaux | |
| 2,628,819 | A | * | 2/1953 | Parsons | 175/103 |
| 2,654,572 | A | * | 10/1953 | Arutunoff | 175/102 |
| 2,877,852 | A | | 3/1959 | Bashara | |
| 2,985,241 | A | | 5/1961 | Hanslip | |
| 3,056,459 | A | * | 10/1962 | Williams | 175/314 |
| 3,087,560 | A | * | 4/1963 | Dodson | 175/314 |
| 3,221,819 | A | * | 12/1965 | Dickinson et al. | 166/233 |
| 3,411,321 | A | * | 11/1968 | Schurman | 464/183 |
| 4,693,318 | A | * | 9/1987 | Petrovic | 166/380 |
| 4,844,182 | A | * | 7/1989 | Tolle | 175/215 |
| 5,097,914 | A | * | 3/1992 | Grotendorst | 175/59 |
| 5,190,102 | A | | 3/1993 | Arterbury et al. | |
| 5,342,520 | A | | 8/1994 | Lyon | |
| 5,624,560 | A | * | 4/1997 | Voll et al. | 210/486 |
| 5,626,200 | A | | 5/1997 | Gilbert et al. | |
| 5,664,628 | A | | 9/1997 | Koehler et al. | |
| 5,667,023 | A | * | 9/1997 | Harrell et al. | 175/45 |
| 5,685,379 | A | * | 11/1997 | Barr et al. | 175/61 |
| 5,979,551 | A | * | 11/1999 | Uban et al. | 166/233 |
| 6,382,318 | B1 | | 5/2002 | Whitlock | |
| 6,431,292 | B2 | * | 8/2002 | Mocivnik et al. | 175/314 |
| 6,478,092 | B2 | * | 11/2002 | Voll et al. | 166/378 |
| 6,598,685 | B1 | * | 7/2003 | Mashburn | 175/57 |

* cited by examiner

*Primary Examiner*—David Bagnell
*Assistant Examiner*—T. Shane Bomar
(74) *Attorney, Agent, or Firm*—Jeffery E. Daly; Brigitte Jeffry Echols

(57) ABSTRACT

A two stage filter for drilling fluid using downhole tools filters solid materials from the drilling fluid and has a first, outer filter section and a second, inner filter section. A portion of the drilling fluid flowing through the first section is received by the second section, and passed on to the fluid using device of the tool. A flow area of the first filter section is greater than a flow area of the second filter section.

21 Claims, 4 Drawing Sheets

TWO STAGE DOWNHOLE DRILLING FLUID FILTER

BACKGROUND OF INVENTION

1. Field of the Invention

This invention relates to downhole tools useful for forming boreholes into the earth. Specifically, a two stage downhole drilling fluid filter for these downhole tools is disclosed that is resistant to clogging by lost circulation material and detritus.

2. Description of the Related Art

When drilling boreholes into the earth, a liquid drilling fluid, now well known simply as "mud" or "drilling mud", is often used to flush the cuttings from the bottom of the well bore to the surface. Originally, the mud was used only for flushing out the cuttings. It was not long however, before the drilling industry realized that the drilling mud, often supplied at high pressures and high flow rates, could be used to power other devices in the drill string that support the drilling operation, including telemetry pressure pulses, power, and primary well control.

However, at times during drilling, a portion of the drilling fluid may flow into the formation being drilled. This is considered a serious situation, and oftentimes special additives called lost circulation materials (LCM) are added to the mud to slow or stop this undesired diversion of the mud. LCM is designed to plug the types of gaps in the rock formations that tend to open when circulation is lost. Unfortunately, these gaps are very similar to the clearances and passageways in the drilling mud powered tools. Consequently, the designers of these tools place limits on how much and what types of LCM can be used with their tools.

Another problem with the use of these drilling fluid using downhole tools is that, at times, other undesirable materials that damage the tools find their way into drilling mud. Items such as plastic wrapping and bagging material and other contaminants introduced by the field personnel can contaminate the drilling mud and block the fluid passages in the mud powered tools as badly as LCM.

It is now commonplace to have numerous tools in the drilling string which use the drilling mud to supply power for their operation. Such tools include drill bits, drilling motors, drilling turbines, rotary directional drilling devices, mud driven electric generators, hole opening devices, measuring while drilling tools, downhole communication devices, and many others.

In many of these tools, the mud powered systems are designed to tolerate these particles by allowing very high volume flow through the system and by providing large restrictions (chokes) when it is necessary to provide a pressure differential.

In other tools, particularly rotary drilling tools, single stage filter elements have been used. The total filter area in these tools is sized in a manner to provide sufficient flow through the filter if the filter gets partially obstructed and blocked by particles. Unfortunately, these filters can collapse under the differential pressure once a sufficiently high number of holes are blocked.

In addition, these filters tend to exhibit uneven wear. After long use, single stage filters tend to wear preferentially at the inlet end. Typically only the first 10% to 50% of the "upstream" end of the filter wears out, leaving the majority on the surface unworn. In some cases this uneven wear forces the entire fluid using tool to be rebuilt when only a portion of the filter erodes away.

Newer types of rotary drilling tools may have drilling fluid powered actuators that have relatively small passageways leading from rotary vales and have fluid chokes to create working pressure differentials in the drilling fluid, as described in U.S. Pat. Nos. 5,265,682; 5,553,678; 5,803,185; 6,089,332; 5,695,01 5; 5,685,379; 5,706,905; 5,553,679; 5,673,763; 5,520,255; 5,603,385; 5,582,259; 5,778,992; 5,971,085 all herein incorporated by reference. In these tools, larger particulates present in the drilling fluid in form of drill cuttings or drilling fluid additives can block the choke holes in the actuation system or cause damage to or jamming of the rotary valve. In particular, high levels of lost circulation material added under certain operating conditions can adversely affect the actuation system.

Therefore, some form of filtering is required in these tools, as these particulates must be filtered from the drilling fluid diverted from the main fluid flow for the hydraulic actuation system. The filter also needs to be kept clean during operation to ensure functionality of the actuators and prevent collapse of the filter element due to a build-up in differential pressure when filter holes get blocked.

Unfortunately, the hereinbefore-described limitations of the single stage filter have affected the performance of these devices. For example, due to space and structural constraints, the prior art filters had relatively small holes for fluid flow. The small hole size limits space availability in the tool and requires the filter element to be a main structural component in the tool. Additionally, the filter hole size and shape was limited to prevent early blockage of the filter element. These constraints became particularly limiting when attempts were made to scale these tools down to smaller borehole diameters.

SUMMARY OF INVENTION

Disclosed is a two stage filter for a downhole tool for filtering solid materials from the drilling fluid. The downhole tool may be any of the type using the drilling fluid for operations, but the two stage filter is particularly applicable to rotary steerable type downhole tools. The two stage filter comprises a first, outer filter section and a second, inner filter section, the drilling fluid flowing from the first section to the second section. The flow area of the first filter section is greater than the flow area of the second filter section.

In this tool, a majority of the drilling fluid flowing through the second filter section is received from the first filter section. The two filter sections of the tool have holes or apertures in them. The average cross-section area for the apertures in the inner section may be greater than an average cross-section area for the apertures in the outer section.

In this tool the average cross-section area for the second plurality of apertures may be more than 20% greater than the average cross-section area for the first plurality of apertures. Also, the flow area of the first filter section of the tool may be at least two times greater than the flow area of the second filter section.

DETAILED DESCRIPTION

Figure 1:
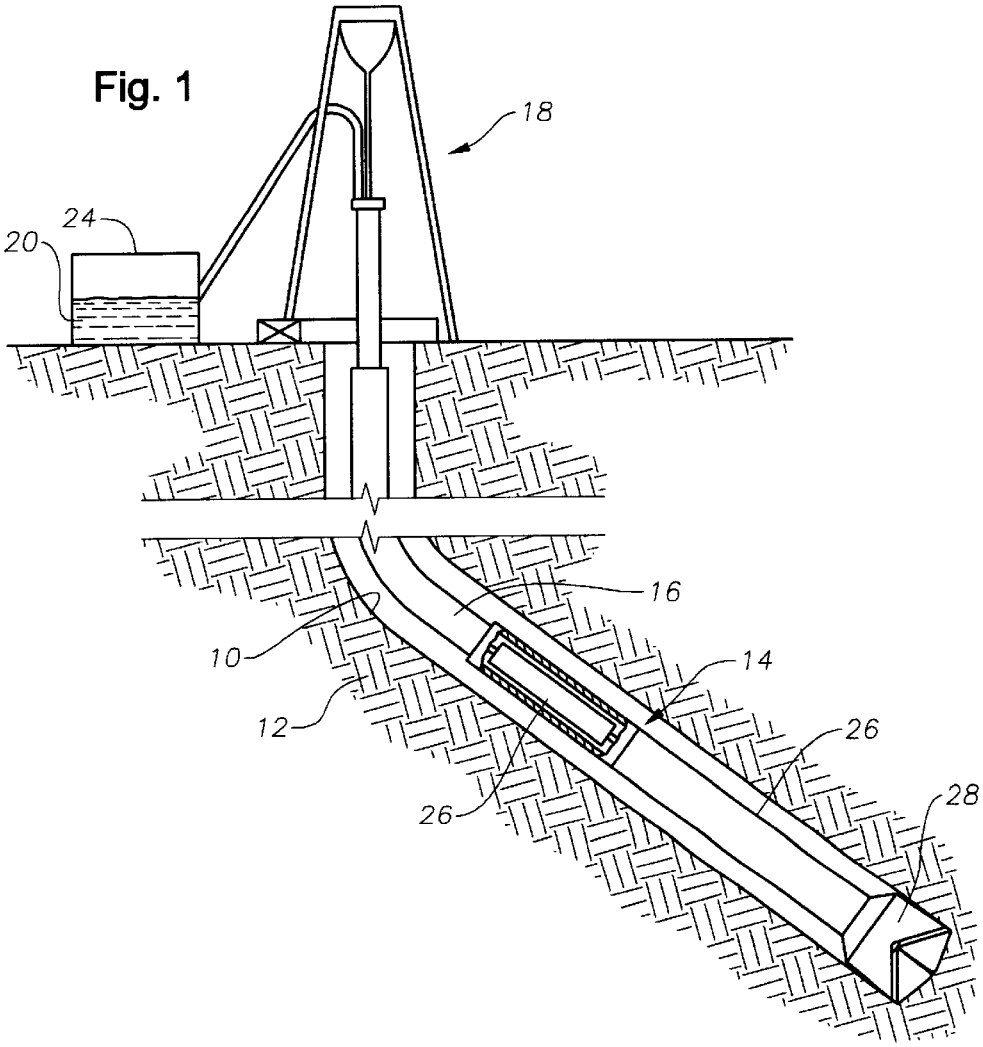
FIG. 1 is a partial section view of a drilling system for forming boreholes in the earth.

Referring now to FIG. 1, when drilling boreholes 10 into earthen formations 12, it is common practice to use a bottom hole assembly 14 as shown in FIG. 1. The bottom hole assembly (BHA) 14 is typically connected to the end of the tubular drill string 16, may be rotatably driven by a drilling rig 18 from the surface. In addition to providing motive force for rotating the drill string 16, the drilling rig 18 also supplies a drilling fluid 20 under pressure and flow created by a surface mud pump (not shown), through the tubular drill string 16 to the bottom hole assembly 14. The drilling fluid 20 is typically laden with drilled abrasive formation material, as it returns to a mud tank 24 and is then repeatedly re-circulated through the borehole 10.

In the BHA 14, may be drilling fluid using downhole tools 26 including a drill bit 28. These fluid using downhole tools 26 may be one or more of drilling motors, drilling turbines, rotary directional drilling devices, mud driven electric generators, hole opening devices, measuring while drilling tools, and downhole communication devices.

Figure 2:
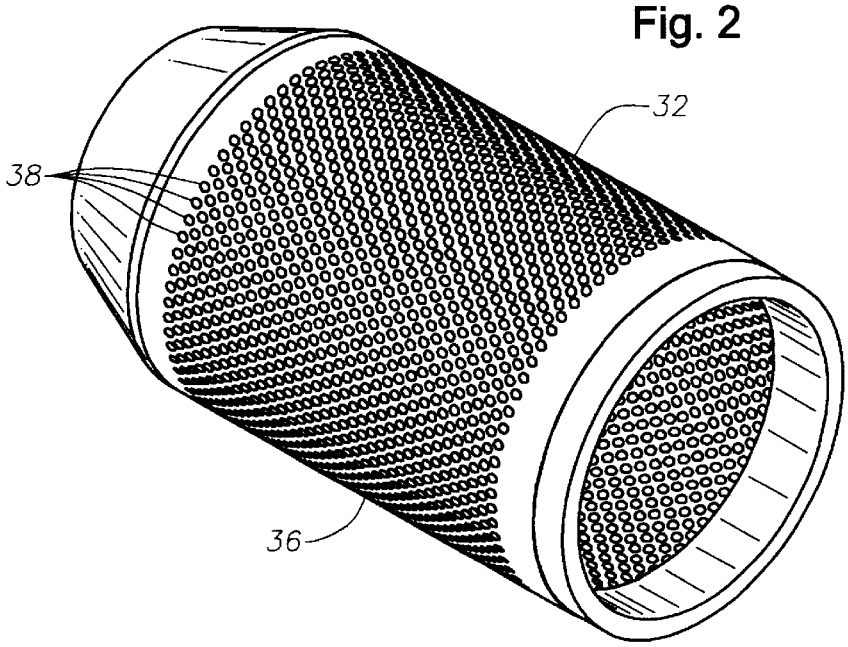
FIG. 2 is a perspective view of the outer filter section of the two stage filter of the present invention.
Figure 3:
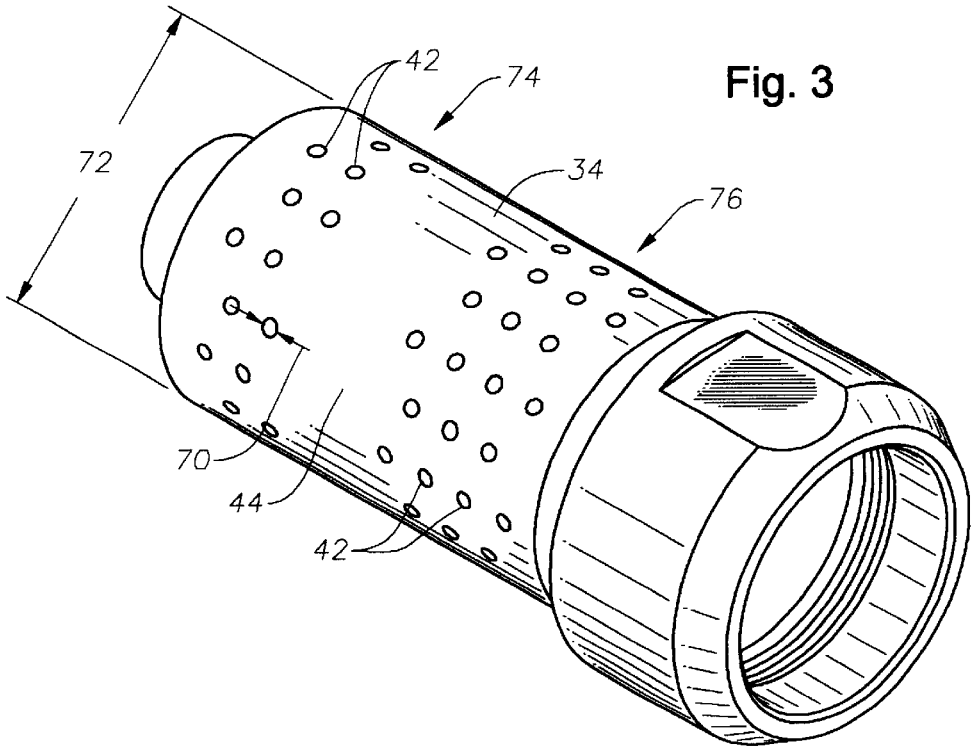
FIG. 3 is a perspective view of the inner filter section of the two stage filter of the present invention.

Referring now to FIGS. 2 and 3, in order to provide a clean supply of pressurized drilling fluid 20 to one of these fluid using downhole tools 26, a two stage filter 30 is provided within the tool 26. The two stage filter 30 is for filtering solid materials from the drilling fluid 20 and has a first, outer filter section 32 and a second, inner filter section 34, the drilling fluid 20 enters the first section 32 through a first set of apertures 38 to the second section 34. A portion of this drilling fluid 20 then flows through a second set of apertures 42 in the second section 34 for supply to the portion of the tool 26 using the drilling fluid 20. A flow area of the first filter section 32 is greater than a flow area of the second filter section 34. Preferably, the flow area of the first filter section 32 is at least two times greater than the flow area of the second filter section 34.

The most common form for apertures 38, 42 is circular holes. For convenience, in this specification these apertures 38, 42 will hereinafter be shown, described and referred to as holes or circular holes, but it should be understood that the term is not intended to limit the invention only to apertures 38, 42 in the form of circular holes, and that the areas and other characteristics of these apertures 38, 42 for the two stage filter 30 of the present invention apply equally to apertures of any shape and configuration.

The first filter section 32 has an outer filter gauze 36 with small filter holes 38 that prevent particulates larger than the hole diameter from passing through. The outer filter gauze 36 has a smooth surface, a very large flow area, and is relatively thin. The passageway of the drilling fluid 20 through the filter holes 38 is thus short. Particles stuck in the filter holes 38 are swept away by the main fluid flow, which is perpendicular to the orientation of the filter holes 38. The filter is thus self-cleaning.

Figure 5:
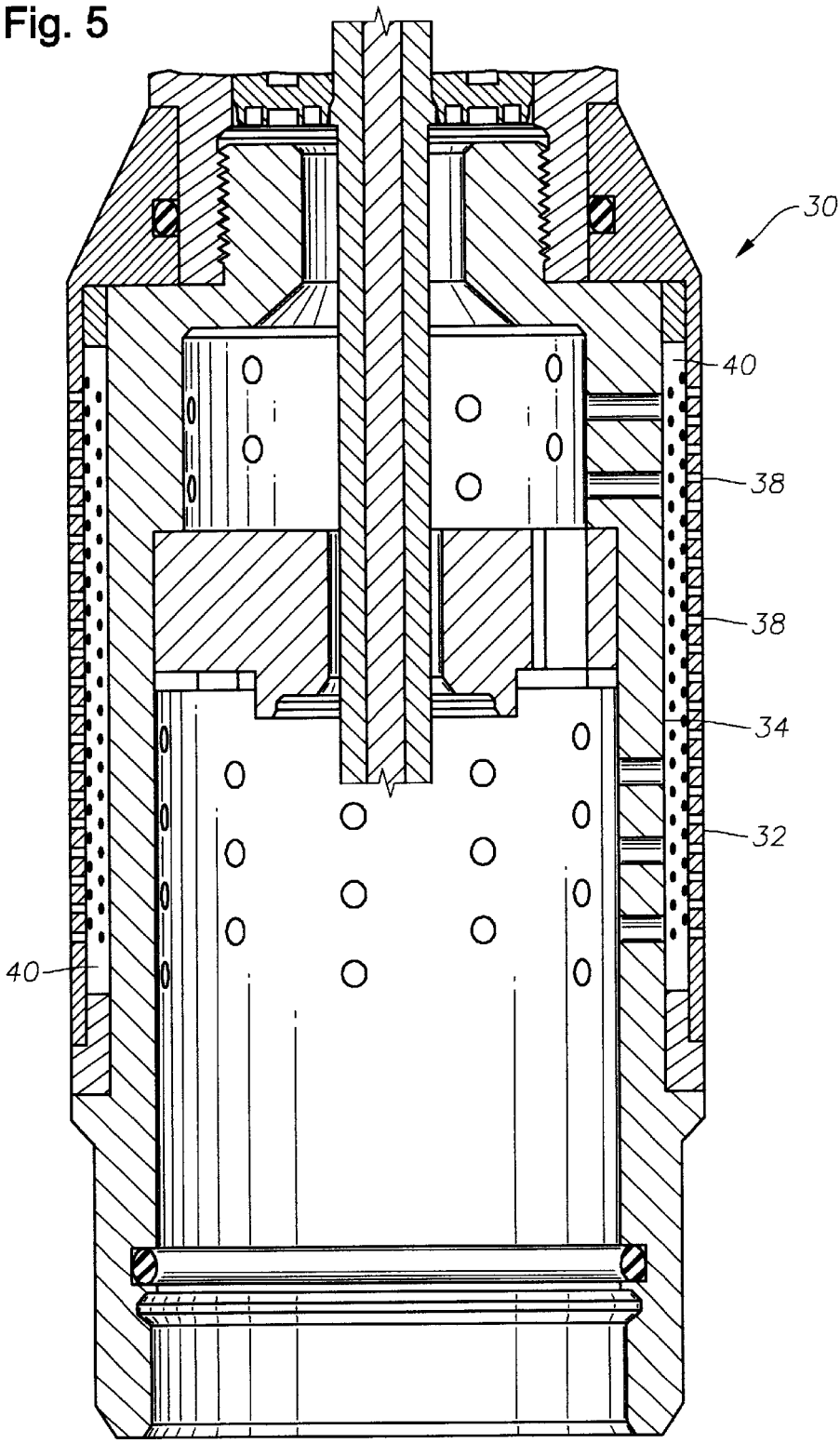
FIG. 5 is a partial section view of the two stage filter of the present invention assembled in the downhole tool of FIG. 4.

After passing the first, outer filter section 32, the fluid is in the small cavity (indicated by numeral 40 in FIG. 5) between the outer filter gauze 36 and second, inner, filter body section 34. The average size (and consequently the average cross-section area) of the filter holes 42 is greater than those of the first, outer filter section 32. However, the total flow area of the second, inner section 34 is much less than that of the first, outer filter section 32. It is desirable that the average cross-section area for the holes 42 of the second filter section 34 be at least 20% larger than the average cross-section area of the holes 38 in the first, outer filter section 32. Due to the difference in hole size (and number of holes as will be described later), the drilling fluid 20 filtered through the first, outer filter section 32 strikes the outside surface shell 44 of the second filter section 34 and is reflected back, resulting in a diffuse flow field in the cavity 40 between the two filter elements. This also reduces or eliminates the uneven wear experienced by prior art filters, at the inlet end of the first filter section 32.

A portion of the drilling fluid 20 reaching the cavity 40 flows back through the first, outer filter section 32 and back into the main flow stream. This aids the removal of particulates blocking holes in the outer filter gauze 36 by the main fluid flow. This outward flow also tends to carry away the larger particles that manage to enter the cavity 40 through the first filter section 32. It is believed that the mass of these particles tends to make them remain in the cavity 40 and therefore swept away, rather than making the abrupt change in direction necessary to enter into the holes 42 of the second, inner filter section 34. A portion of the filtered drilling fluid 20 within the cavity 40 does however pass through the second filter section 34 to be directed to the fluid using device 26.

Figure 4:
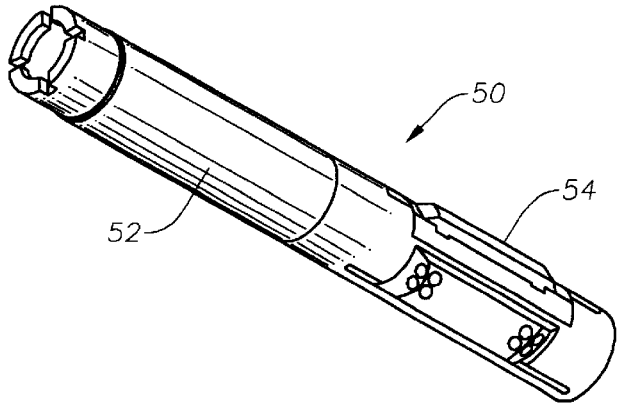
FIG. 4 is a perspective view of a rotary steerable tool, wherein the two stage filter of the present invention may be used.
Figure 6:
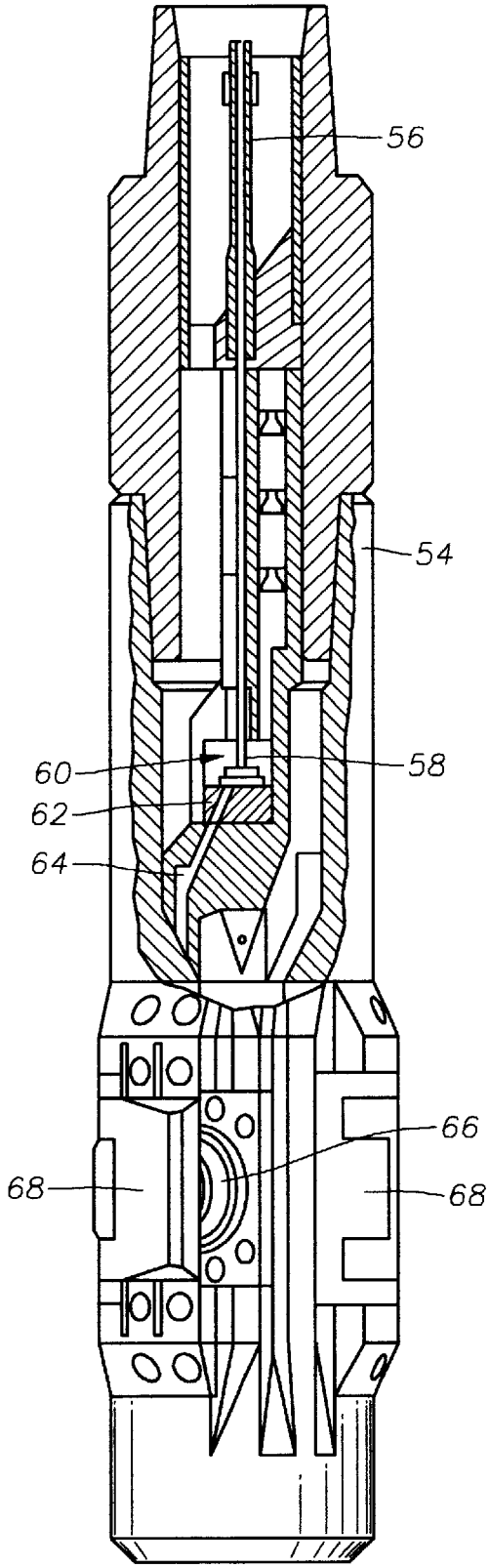
FIG. 6 is a partial section view of a section of the rotary steerable tool of FIG. 4.

Referring now to FIGS. 4 and 6, in one embodiment, a rotary steerable tool 50 consists of two major components, a control unit 52 and a bias unit 54. The maximum rated operating temperature for the rotary steerable tool 50 is 125° C. (257°F.) with a hydrostatic pressure rating of 20,000 psi (138 MPa). The rotary steerable tool 50 operates at flow rates of 200 to 400 gpm.

The rotary steerable tool 50 provides hole direction control by selectively providing hydraulic pressure in form of drilling fluid 20 to hinged pads 56 mounted on the outer diameter of the bias unit 54.

The bias unit 54 is linked to the control unit 52 via the control shaft 56. This control shaft 56 carries the first portion 58 of a 3-way rotary valve, generally indicated by reference numeral 60. The lower member 62 of the rotary valve 60, rotating with the bias unit 54, has three ports 64 (only one is shown), each leading to one of the three actuators 66 (only one is shown). As each of the three ports 64 in the lower member 62 rotates into alignment with the opening in the (non-rotating) first portion 58 of the rotary valve 60, the corresponding pad 68 is actuated moving outwards, and applying a force between the borehole 10 and the bias unit 54.

Approximately 4% of the drilling fluid flowing through the rotary steerable tool 50 is diverted from the main flow and utilized for the actuation of the pads. Because the valve, passageways, and the ports are vulnerable to blockage by solids in the drilling fluid 20, the drilling fluid 20 is passed through the two-stage filter 30 prior to delivery to the valve. A differential pressure of about 750 psi (5.2 MPa) is used between the inside of the tool and the borehole for the pad actuation.

In the first, outer filter section 32 the thickness of the shell is quite small compared to the diameter of the holes 38. Furthermore, the holes 38 occupy a very high portion of the surface area of the first filter section 32. The number of holes 38 and the thinness of the shell make this first filter section 32 appear as a gauze.

In the embodiment illustrated in FIG. 2, the first, outer filter section 34 has a diameter of 53.5 mm, a shell thickness of 0.8 mm, and an active length of 65.0 mm. Therefore, the first filter section 34 has a total active surface area of about 10,589 mm squared. The holes 38 have a 1.0 mm diameter and occupy 2,262 mm squared of that surface. Therefore, the flow area of the first, outer filter section 32 is 2,262 mm squared and the area density of the holes is about 21% of the total area of the first filter section 32.

The second, inner filter section 34 forms a main load bearing component of the rotary steerable tool 50 and the shell 44 has a relatively thick wall.

In the second filter section 34, the thickness of the shell 44 is quite high compared to the average diameter 70 of the holes 42. It is believed that to have the above described self cleaning effect, the average diameter 70 of the holes 42 in the second filter section 34 should be less than double the thickness of the shell 44. In other words, in the second, inner filter section 34 of the present invention, the ratio of the average hole 42 diameter 70 to the thickness of the shell is less than 2. This is believed to enhance the ability to eject particles from the flow stream back into the void space 44 between the filter sections 32, 34.

In the preferred embodiment shown, this ratio is far less, for the hole 42 diameter is 2.5 mm and the shell thickness is 3.5 mm, making the hole diameter to shell thickness ratio equal to about 0.72. It should be understood, however, that this ratio would be very dependent upon the diameter 72 of the second filter section 34. As the diameter 72 of the second filter section 34 decreases with scaling of the tool to smaller borehole diameters, the ratio of the average hole 42 diameter to the thickness of the shell 44 will necessarily increase, approaching the value of 2.

The average cross-section area for the holes 42 of the second filter section is about 4.91 mm squared, and the average cross-section area for the holes 38 of the first filter section is about 0.79 mm squared. Therefore, in the preferred embodiment, the average cross-section area for the holes 42 of the second filter section is more than 6.25 greater than the average cross-section area of the holes 38 in the first filter section.

Also in the preferred embodiment, the holes 42 of the second, inner filter section 34 are grouped into a first region 74 and a second region 76. There is a relationship between the area of the holes 42 in the region 74, 76 of the shell 44 of the second filter section 34 to the total surface area of that region 74, 76 of the shell 44. This is necessary to make the drilling fluid 20 which is filtered through the first filter section 32 reflect back after it hits the outside surface shell 44 of the second filter section 34, as mentioned earlier. A relatively high portion of the surface shell 44 needs to be free of holes 42 for the drilling fluid 20 to be reflected in this manner. The resulting diffuse flow field in the cavity 40 between the two filter elements 32, 34 carries away the ejected particles described above and has proven to be remarkably self-cleaning. The result is that this two stage filter system filters much more of the solids from the drilling fluid 20 than the single stage filters of the prior art.

The second, inner filter section 34 has eleven rows of these holes, making the total flow area of the second filter section 34 just 431 mm squared. The total flow area of the first, outer filter section 32 is much greater 5.24 times greater to be exact in this embodiment.

It has been found that the area density of the holes 42 in regions 74, 76 of the shell 44 should be less than about 0.15 of the total area of that region 74, 76 of the shell 44. This value is much lower than what has been used previously, and it is necessary to maintain a relatively high flow rate of the drilling mud through the holes 42. The high flow rate helps prevent the particles which do manage to get past the first, outer filter section 32 from clogging the holes 42 for any length of time. In order to assure the high flow rate through the holes 42, the total number of holes 42 in the shell 44 are limited. Accordingly, the holes are grouped into multiple regions 74, 76 of the shell 44 as shown. Alternately, the holes 42 may be grouped in other manners, or just evenly dispersed across the whole surface of the shell 44. The limitation, however, is that the area density of the holes 42 in each region 74, 76 of the shell 44 remain less than about 0.15.

In the embodiment illustrated in FIG. 3, the first region 74 of the second filter section 34 has two rows of eight by 2.5 mm diameter holes 42 spaced over the 10.5 mm wide region 74. In the preferred embodiment, therefore, the ratio of hole area to shell area is less than about 0.06. Again this ratio is sensitive to the overall diameter 72 of the shell 44 of the second filter section, 34 and therefore this ratio may vary from about 0.02 to 0.15 depending upon the exact design, while still providing the described benefit.

Although the two stage filter arrangement of the present invention has been described in relation to downhole rotary steerable drilling tools, the filter arrangement has applications in numerous other type of downhole fluid using devices. For example, many devices use drilling fluid to create impulses in the drilling fluid to communicate data from downhole to the surface. The two-stage filter of the present invention fitted in these devices would allow designs with higher signaling accuracy, but were prone to clogging without the filter. It is also desirable to use solenoids in downhole fluid using devices for control of fluid flow. Past solenoid designs adapted to operate without filters had very high power consumption due mainly to the anti-clogging design. Much smaller, less powerful solenoids may now be used in tools equipped with the two stage filter arrangement of the present invention.

Whereas the present invention has been described in particular relation to the drawings attached hereto, it should be understood that other and further modifications apart from those shown or suggested herein, may be made within the scope and spirit of the present invention.

What is claimed is:

1. A downhole tool comprising a drilling fluid using device and a two stage filter for filtering solid materials from the drilling fluids, the two stage filter comprising a first, outer filter section having a first plurality of flow apertures and a second, inner filter section having a second plurality of apertures, the drilling fluid flowing from the first section to the second section, wherein a flow area of the first filter section is greater than a flow area of the second filter section, and wherein an average cross-section area for the second plurality of apertures is more than 20% greater than an average cross-section area for the first plurality of apertures.

2. A downhole tool comprising a drilling fluid using device and a two stage filter for filtering solid materials from the drilling fluid, the two stage filter comprising a first, outer filter section having a first plurality of flow apertures and a second, inner filter section having a second plurality of apertures, the drilling fluid flowing from the first section to the second section, wherein a flow area of the first filter section is at least two times greater than a flow area of the second filter section.

3. A downhole tool comprising a drilling fluid using device and a two stage filter for filtering solid materials from the drilling fluid, the two stage filter comprising a first, outer filter section having a first plurality of flow apertures and a second, inner filter section having a second plurality of apertures, the drilling fluid flowing from the first section to the second section, wherein a flow area of the first filter section is grater than a flow area of the second filter section, and wherein the ratio of an average diameter of the second plurality of apertures to a thickness of a shell of the second filter section is less than 2.

4. The downhole tool of claim 3 wherein the ratio of the average diameter of the second plurality of apertures to the shell thickness is about 0.72.

5. A downhole tool comprising a drilling fluid using device and a two stage filter for filtering solid materials from the drilling fluid, the two stage filter comprising a first, outer filter section and a second, inner filter section, the drilling fluid flowing from the first section to the second section, wherein a flow area of the first filter section is greater than a flow area of the second filter section, and wherein a ratio of the flow area of the second filter section to a total surface area of the second filter section is less than about 0.15.

6. The downhole tool of claim 5 wherein the ratio of the flow area of the second filter section to the total surface area of the second filter section is in the range from about 0.02 to about 0.15.

7. The downhole tool of claim 6 wherein the ratio of the flow area of the second filter section to the total surface area of the second filter section is less than about 0.06.

8. A two state filter for filtering solid materials from a drilling fluid comprising a first, outer filter section having a first plurality of flow apertures and a second, inner filter section having a second plurality of flow apertures, the drilling fluid flowing from the first section to the second section, wherein a flow area of the first filter section is greater than a flow area of the second filter section and wherein an average cross-section area for the second plurality of apertures is more than 20% greater than an average cross-section area for the first plurality of apertures.

9. A two stage filter for filtering solid materials from a drilling fluid comprising a first, outer filter section having a first plurality of flow apertures and a second, inner filter section having a second plurality of flow apertures, the drilling fluid flowing from the first section to the second section, wherein a flow area of the first filter section is at least two times greater than a flow area of the second filter section.

10. A two stage filter for filtering solid materials from a drilling fluid comprising a first, outer filter section having a first plurality of flow apertures and a second, inner filter section having a second plurality of flow apertures, the drilling fluid flowing from the first section to the second section, wherein a flow area of the first filter section is greater than a flow area of the second filter section, and wherein the ratio of an average diameter of the second plurality of apertures to a thickness of a shell of the second filter section is less than 2.

11. The two stage filter of claim 10 wherein the ratio of the average diameter of the second plurality of apertures to the shell thickness is about 0.72.

12. A two stage filter for filtering solid materials from a drilling fluid comprising a first, outer filter section and a second, inner filter section, the drilling fluid flowing from the first section to the second section, wherein a flow area of the first filter section is greater than a flow area of the second filter section, and wherein a ratio of the flow area of the second filter section to a total surface area of the second filter section is less than about 0.15.

13. The two stage filter of claim 12 wherein the ratio of the flow area of the second filter section to the total surface area of the second filter section is in the range from about 0.02 to about 0.15.

14. The two stage filter of claim 13 wherein the ratio of the flow area of the second filter section to the total surface area of the second filter section is less than about 0.06.

15. A rotary steerable downhole tool comprising a two stage filter for filtering solid materials from the drilling fluid, the two stare filter comprising a first, outer filter section having a first plurality of flow apertures and a second, inner filter section having a second plurality of flow apertures, the drilling fluid flowing from the first section to the second sections wherein a flow area of the first filter section is greater than a flow area of the second filter section, and wherein an average cross-section area for the second plurality of apertures is more than 20% greater than an average cross-section area for the first plurality of apertures.

16. A rotary steerable downhole tool comprising a two stage filter for filtering solid materials from the drilling fluid, the two star filter comprising a first, outer filter section having a first plurality of flow apertures and a second, inner filter section having a second plurality of flow apertures, the drilling fluid flowing from the first section to the second section, wherein a flow area of the first filter section is at least two times greater than a flow area of the second filter section.

17. A rotary steerable downhole tool comprising a two stage filter for filtering solid materials from the drilling fluid, the two stage filter comprising a first, outer filter section having a first plurality of flow apertures and a second, inner filter section having a second plurality of flow apertures, the drilling fluid flowing from the first section to the second section, wherein a flow area of the first filter section is greater than a flow area of the second filter section, and wherein the ratio of an average diameter of the second plurality of apertures to a thickness of a shell of the second filter section is less than 2.

18. The rotary steerable downhole tool of claim 17 wherein the ratio of the average diameter of the second plurality of apertures to the shell thickness is about 0.72.

19. A rotary steerable downhole tool comprising a two stage filter for filtering solid materials from the drilling fluid, the two stare filter comprising a first, outer filter section and a second, inner filter section the drilling fluid flowing from the first section to the second section, wherein a flow area of the first filter section is greater than a flow area of the second filter section, and wherein a ratio of the flow area of the second filter section to a total surface area of the second filter section is less than about 0.15.

20. The rotary steerable downhole tool of claim 19 wherein the ratio of the flow area of the second filter section to the total surface area of the second filter section is in the range from about 0.02 to about 0.15.

21. The rotary steerable downhole tool of claim 20 wherein the ratio of the flow area of the second filter section to the total surface area of the second filter section is less than about 0.06.

* * * * *